US008926214B2

(12) United States Patent
Lah

(10) Patent No.: US 8,926,214 B2
(45) Date of Patent: Jan. 6, 2015

(54) ROTATING TYPE STICK

(76) Inventor: Jeh-Kun Lah, Seoul (KR)

( * ) Notice: Subject to any disclaimer, the term of this patent is extended or adjusted under 35 U.S.C. 154(b) by 9 days.

(21) Appl. No.: 13/466,265

(22) Filed: May 8, 2012

(65) Prior Publication Data

US 2012/0288326 A1 Nov. 15, 2012

(30) Foreign Application Priority Data

May 13, 2011 (KR) ..... 10-2011-0045169

(51) Int. Cl.
*F16B 7/10* (2006.01)
*A45B 9/00* (2006.01)

(52) U.S. Cl.
CPC ..... *A45B 9/00* (2013.01); *A45B 2009/007* (2013.01)
USPC ..... 403/109.3; 135/75

(58) Field of Classification Search
USPC ..... 403/109.1, 109.2, 109.3, 109.6, 109.8, 403/325, 328; 135/75, 82
See application file for complete search history.

(56) References Cited

U.S. PATENT DOCUMENTS 2,490,369 A * 12/1949 Neuwirth ..... 248/188.5
2,588,901 A * 3/1952 Weikart ..... 403/292
2,675,257 A * 4/1954 Specht ..... 403/328
2,719,688 A * 10/1955 Seifert ..... 248/188.5
2,888,022 A * 5/1959 Fanning ..... 135/82
2,980,456 A * 4/1961 McMullin ..... 403/328
3,103,375 A * 9/1963 McMullin ..... 403/300
3,449,003 A * 6/1969 Hunt ..... 403/324
3,669,463 A * 6/1972 Boudreau ..... 280/47.371
3,980,409 A * 9/1976 Turner ..... 403/108
4,042,305 A * 8/1977 Vincent ..... 403/14
4,079,978 A * 3/1978 McMullin ..... 294/174
4,244,602 A * 1/1981 Allsop et al. ..... 280/821
4,300,300 A * 11/1981 Neuland et al. ..... 40/610
4,385,849 A * 5/1983 Crain ..... 403/109.3
4,508,468 A * 4/1985 Irwin ..... 403/328
4,809,725 A * 3/1989 Champigny ..... 135/75
5,255,993 A * 10/1993 Kovacs ..... 403/328
5,287,869 A * 2/1994 Wu ..... 135/25.1
5,607,173 A * 3/1997 Lai ..... 280/293
6,213,672 B1 * 4/2001 Varga ..... 403/109.2
6,595,226 B2 * 7/2003 Uemura ..... 135/75
6,854,916 B2 * 2/2005 Hsieh ..... 403/109.3
7,025,015 B2 * 4/2006 Wilcox et al. ..... 114/255
7,229,101 B2 * 6/2007 Lenhart ..... 280/819
7,950,632 B2 * 5/2011 Roiser ..... 267/129
8,479,932 B2 * 7/2013 Carney ..... 211/105.5
2001/0027802 A1 * 10/2001 McGrath ..... 135/65
2010/0054852 A1 * 3/2010 Snyder ..... 403/301
2010/0122718 A1 * 5/2010 Lah ..... 135/75
2010/0170548 A1 * 7/2010 Lenhart ..... 135/75

* cited by examiner

*Primary Examiner* — Daniel P Stodola
*Assistant Examiner* — Daniel Wiley
(74) *Attorney, Agent, or Firm* — Nixon Peabody LLP; Jeffrey L. Costellia

(57) ABSTRACT

A stick has a first tube member and a second tube member connected to each other in the length direction; and a connection member connected to one end portion of the second tube member, wherein the first tube member is selectively locked to or unlocked from the connection member, the second tube member is rotatably connected to the connection member. When the first tube member is locked to the connection member, the first tube member and the connection member are fixed to each other, and the second tube member is freely rotatable relative to the first tube member.

5 Claims, 10 Drawing Sheets

ROTATING TYPE STICK

CROSS-REFERENCE TO RELATED APPLICATION

This application claims priority to Korean Patent Application No. 10-2011-0045169, filed on May 13, 2011, and all the benefits accruing therefrom under 35 U.S.C. §119, the contents of which in its entirety are herein incorporated by reference.

BACKGROUND

1. Field

The present disclosure relates to a rotating type stick, and more particularly, to a rotating type stick in which tube members constituting a stick are rotatable relative to each other and are movable in a manner similar to the movement of an antenna.

2. Description of the Related Art

A stick has been used to assist the walk of climbers or old and weak persons. Since the weight may distributed through the stick pressed against the ground, the climbers or the old and weak persons may walk more comfortably compared to the case where the stick is not used.

In order for the user to simply carry or accommodate the stick, an antenna type stick which may be shortened in a manner similar to the movement of the antenna is used.

The antenna type stick is generally configured by connecting an upper tube member to a lower tube member, having a diameter smaller than that of the upper tube member, in the length direction.

When a user desires to shorten such an antenna type stick, the lower tube member may be pressed into the upper tube member. In contrast, when the user desires to lengthen the stick, the lower tube member existing in the upper tube member may be taken out. When the upper tube member and the lower tube member are locked and fixed to each other while the stick is lengthened, the stick is maintained at a length in which the user may comfortably use the stick.

As for the antenna type stick according to the related art, it is general that the upper tube member and the lower tube member are locked and fixed to each other so as to maintain the length of the stick while the stick is lengthened.

However, according to the locking unit of the related art, if a rotational force is applied to the upper tube member and/or the lower tube member when the stick is in use, the locking unit may be released or damaged due to the force. When the locking unit is unexpectedly released or damaged, the user may be wounded.

When an additional structure for preventing the damage of the locking unit is formed inside the tube member so as to prevent these problems, the diameter of the lower tube member relatively decreases with respect to the diameter of the upper tube member, which may eventually cause a result in which the rigidity of the entire stick is degraded. Furthermore, there is a problem that the entire stick becomes heavy.

SUMMARY

The present disclosure is directed to providing a rotating type stick capable of firmly maintaining a locking state of a locking unit even when a rotational force is applied to tube members constituting a stick In one aspect, there is provided a stick including: a first tube member and a second tube member connected to each other in the length direction; and a connection member connected to one end portion of the second tube member, wherein the first tube member is selectively locked to or unlocked from the connection member, the second tube member is rotatably connected to the connection member, and the second tube member is rotatable relative to the first tube member while the first tube member and the connection member are maintained in a locking state.

The connection member may include a button, the first tube member may be provided with a button hole to which the button is fastened, and the first tube member may be selectively locked to or unlocked from the connection member as the button is fastened to or separated from the button hole.

The connection member may include a body portion provided with the button and a connection portion extending from the body portion, a sleeve accommodating the connection portion may be fixed and connected to one end portion of the second tube member, and the sleeve may be rotatable about the connection portion.

The sleeve may be slidable with respect to the connection portion, and a spring may be provided between the sleeve and the connection portion.

The first tube member and the second tube member may have a cylindrical shape, and the connection member and the second tube member may be slidable inside the first tube member.

The inside of the first tube member may be provided with a rotation preventing groove formed along the length direction of the first tube member, a body of the connection member may be provided with a rotation preventing protrusion configured to be fastened to the rotation preventing groove, and the connection member may be prevented from rotating inside the first tube member.

The button hole may penetrate the outer surface of the first tube member, and when the button is fastened to the button hole, the end portion of the button may be exposed to the outside of the first tube member.

The end portion of the button may be inclined so that its slope surface faces the opposite side to the installation direction of the second tube member.

According to the disclosure, since it is possible to prevent the locking state of the locking unit from being released or damaged even when an impact is applied to the stick, the reliability and the durability of the stick may be improved.

BRIEF DESCRIPTION OF THE DRAWINGS

The above and other aspects, features and advantages of the disclosed exemplary embodiments will be more apparent from the following detailed description taken in conjunction with the accompanying drawings in which.

DETAILED DESCRIPTION

Exemplary embodiments now will be described more fully hereinafter with reference to the accompanying drawings, in which exemplary embodiments are shown. The present disclosure may, however, be embodied in many different forms and should not be construed as limited to the exemplary embodiments set forth therein.

Figure 1:
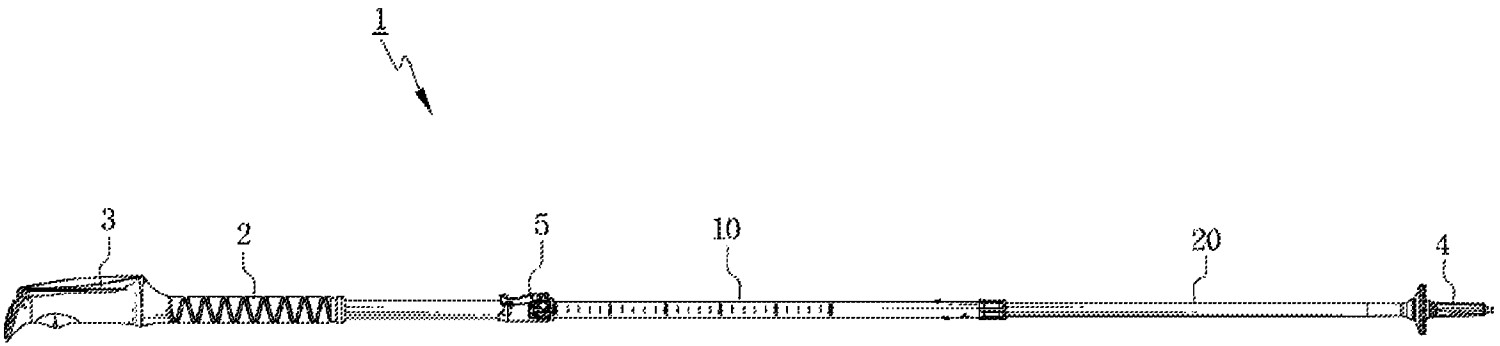
FIGS. 1 and 2 illustrate a stick according to an embodiment of the disclosure.
Figure 2:
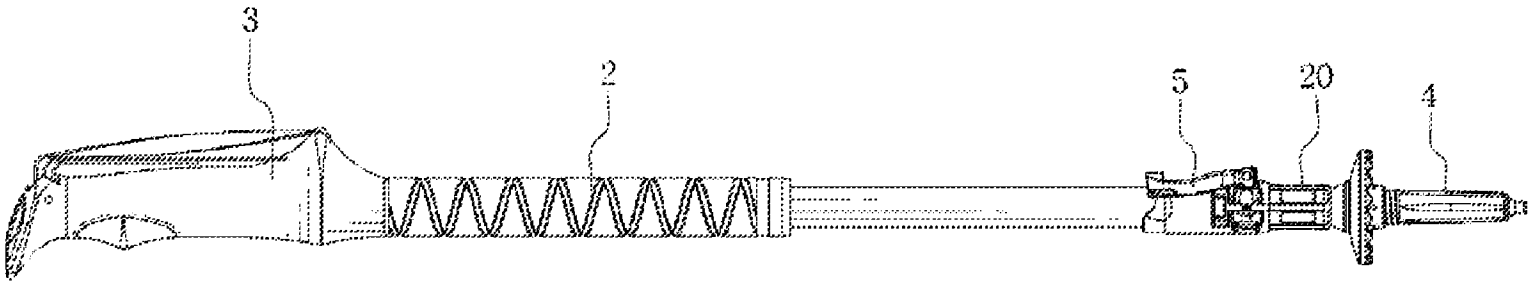

FIGS. 1 and 2 illustrate a stick 1 according to an embodiment of the disclosure.

As shown in FIG. 1, the stick 1 according to the embodiment is configured by connecting an upper tube member 2, a first tube member 10, and a second tube member 20 to each other.

In the specification, the "upper side" means the direction in which the handle of the stick 1 is positioned, and the "lower side" means the opposite direction of the "upper side" in the length direction. Furthermore, the terms of the "upper end" means the end portion in the upward direction, and the term of the "lower end" means the end portion opposite to the "upper end".

A handle member 3 which may be gripped by a user is connected to the upper end of the upper tube member 2. The first tube member 10 is inserted from the lower end of the upper tube member 2 into the upper tube member 2 and is connected to the upper tube member 2. The lower end of the upper tube member 2 is provided with a fixing unit 5.

The second tube member 20 is inserted from the lower end of the first tube member 10 into the first tube member 10 and is connected to the first tube member 10. The lower end of the second tube member 20 is provided with a support member 4 which allows a user to be easily supported on the ground through the stick 1.

The tube members 2, 10, and 20 of the stick 1 according to the embodiment are cylindrical tube members, and the diameter of the lower tube member is smaller than the diameter of the upper tube member. Accordingly, the first tube member 10 is slidable into the upper tube member 2, and the second tube member 20 is slidable into the first tube member 10.

FIG. 2 illustrates a state where the first tube member 10 is completely inserted into the upper tube member 2 and the second tube member 20 is completely inserted into the first tube member 10.

According to such a configuration, the user may carry or accommodate the stick 1 in a state where the stick 1 is completely shortened as shown in FIG. 2. In a case where the user desires to use the stick 1, the first tube member 10 is taken out downward from the upper tube member 2, and the second tube member 20 is taken out downward from the first tube member 10, so that the stick 1 may be lengthened as shown in FIG. 1. The user may fix the first tube member 10 and the upper tube member 2 by using the fixing unit 5 after taking the first tube member 10 out from the upper tube member 2 by a desired extent. The fixing unit 5 of the stick according to the embodiment may be configured as a unit having any configuration in which the upper tube member 2 may be fixed to the first tube member 10 inserted and connected to the upper tube member 2. For example, the upper tube member 2 and the first tube member 10 may have a screw locking type connection structure in which the first tube member 10 and the upper tube member 2 are screw-connected to each other and the screw is loosened or tightened by relatively rotating the first tube member 10 with respect to the upper tube member 2 so as to adjust the length of the stick. Since the specific configuration of the fixing unit 5 departs from the technical spirit of the disclosure, the specific description thereof will be omitted herein.

Figure 3:
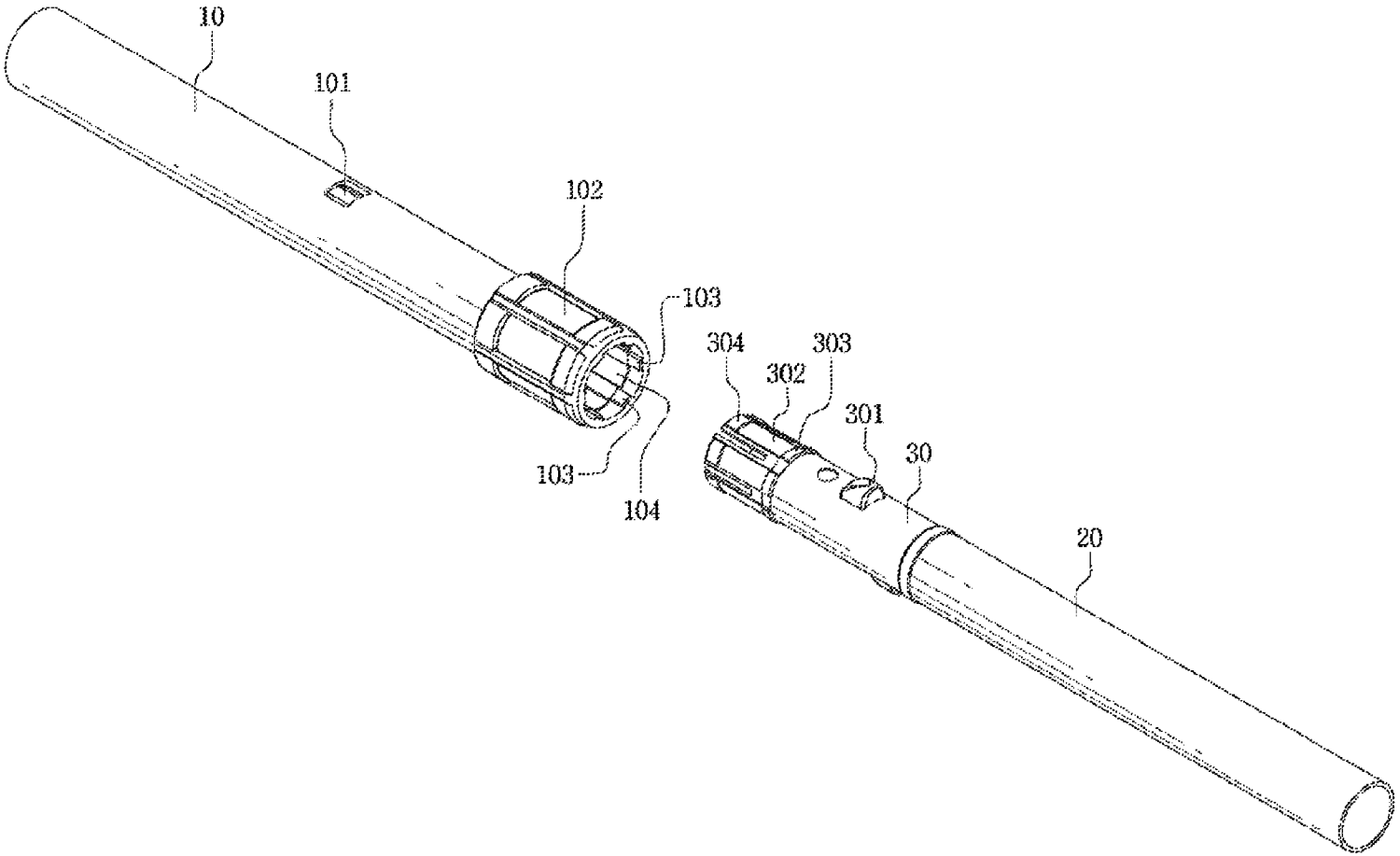
FIG. 3 illustrates a part of a first tube member, a second tube member, and a connection member of the stick according to the embodiment of the disclosure.

The first tube member 10 and the second tube member 20 are connected to the connection member 30 (see FIG. 3). FIG. 3 illustrates a state where the first tube member 10 and the second tube member 20 according to the embodiment are separated from each other, and FIG. 4 illustrates a state where the half sides of the first tube member 10 and the second tube member 20 of FIG. 3 are cut away in the length direction.

Figure 4:
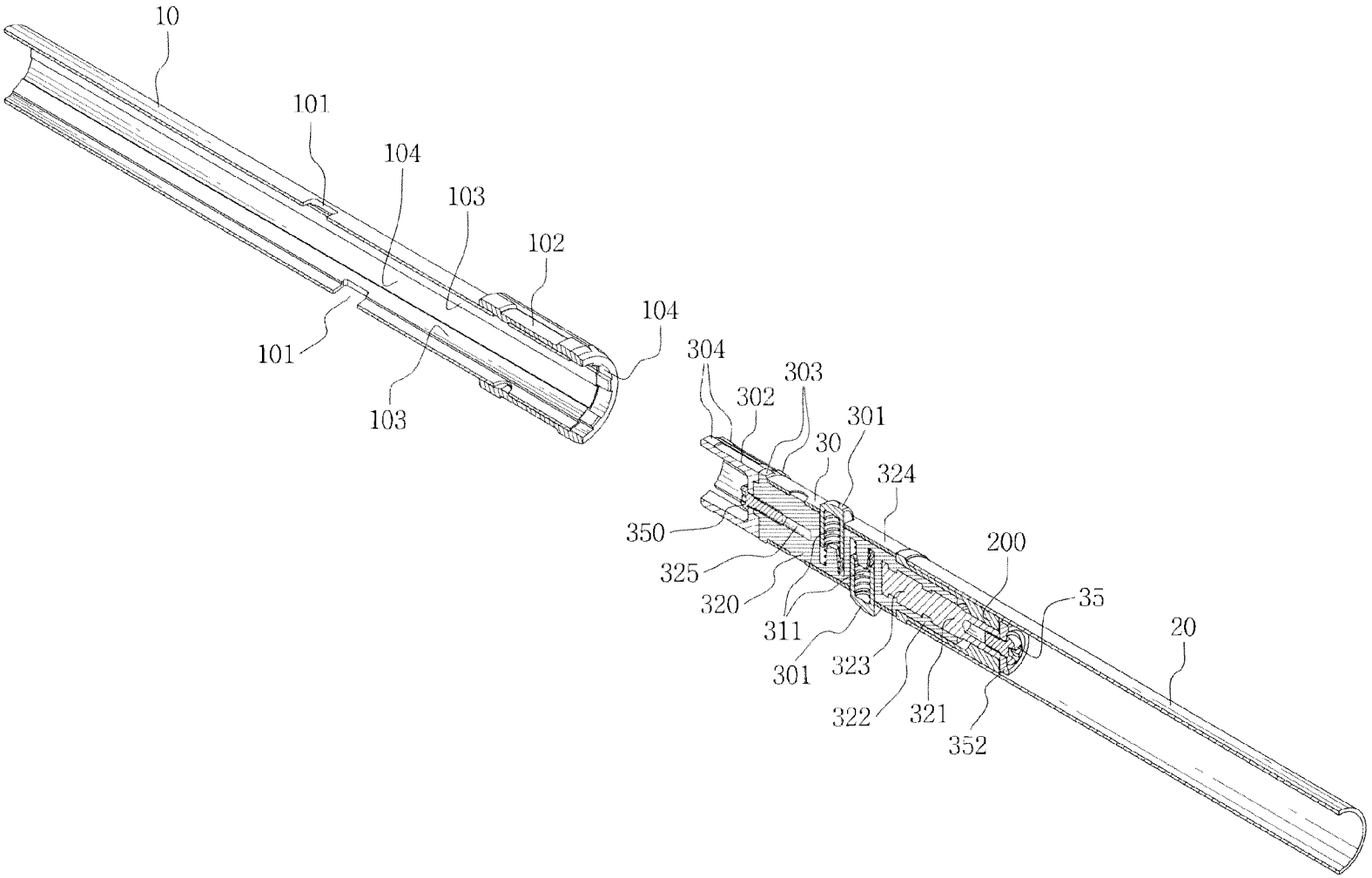
FIG. 4 is a cross-sectional perspective view in which the first tube member, the second tube member, and the connection member of FIG. 3 are cut away in the length direction.

As shown in FIGS. 3 and 4, the connection member 30 is connected to the upper end of the second tube member 20. The second tube member 20 may be rotatably connected to the connection member 30, and the first tube member 10 may be selectively locked to or unlocked from the connection member 30. Such a configuration will be described in more detail later.

The connection member 30 includes a substantially cylindrical body portion 320 and a connection portion 321 which extends downward from the body portion 320 and is inserted into the second tube member 20. The connection portion 321 includes an aluminic insert 323 and a protrusion portion 322 which surrounds a part of the insert 323 and is integrated with the body portion 320.

In order to manufacture the connection member 30 having the above-described configuration, first, a melted liquid which is obtained by melting a synthetic resin is poured into a mold and is cured in a state where the aluminic insert 323 is positioned inside the mold having a shape corresponding to the body portion 320 and the protrusion portion 322, thereby molding the body portion 320 and the protrusion portion 322.

The body portion 320 of the connection member 30 which is exposed to the outside of the second tube member 20 is surrounded by a housing 324, so that it is protected from the external environment. The upper outer diameter portion of the body portion 320 is provided with plural rotation preventing protrusions 303 which are formed in a radial shape along the radial direction of the body portion 320.

The upper end portion of the body portion 320 is provided with a first guide member 302 which allows the connection member 30 to be easily inserted into the first tube member 10.

Referring to FIG. 3, the first guide member 302 includes plural cut pieces, and the upper circumference of each cut piece is provided with a rotation preventing protrusion 304.

A screw connection hole 325 is formed at the center of the upper end portion of the body portion 320, and the first guide member 302 is connected to the upper end portion of the body portion 320 in a manner such that the screw member 350 is fastened to the screw connection hole 325.

The body portion 320 of the connection member 30 is provided with two buttons 301 which are formed in the vertical direction of the body portion 320. The button 301 is partially inserted into the body portion 320 through a passage hole formed in the body portion 320, and the end portion of the button 301 is exposed to the outside of the body portion 320.

A spring 311 is provided inside the button 301. When the user presses the button 301, the button 301 is pressed inward in the body portion 320. Then, when the user removes the pressing force, the button returns to the original position due to the elastic restoring force of the spring 311.

The connection member 30 having the above-described configuration is rotatable relative to the second tube member 20. Hereinafter, this will be described in more detail by referring to FIG. 5.

Figure 5:
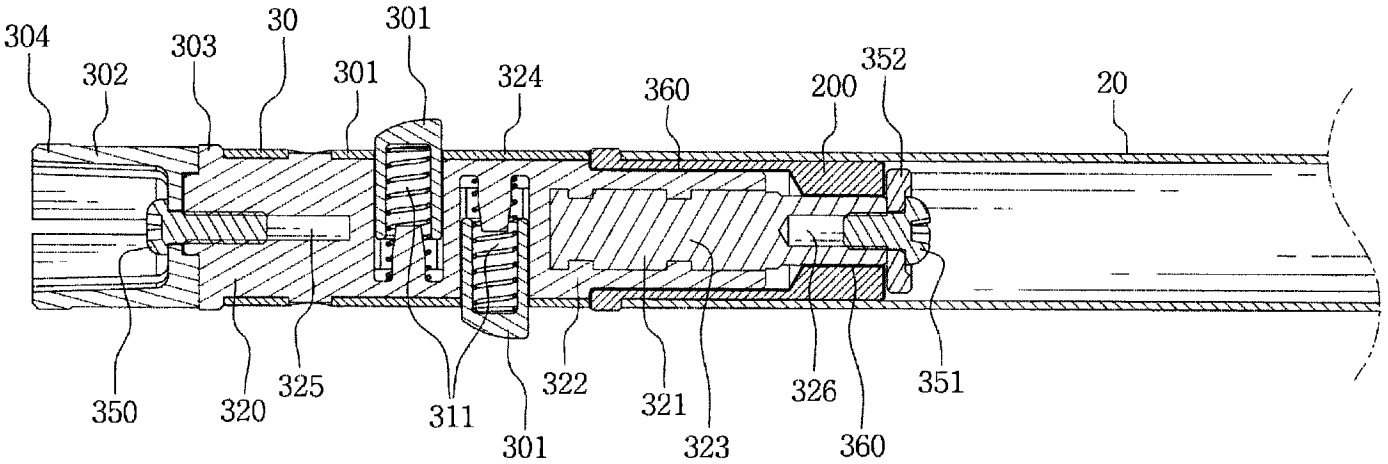
FIG. 5 is a cross-sectional view illustrating the second tube member and the connection member of FIG. 3.

FIG. 5 is a cross-sectional view illustrating the second tube member 20 and the connection member 30 connected to each other.

As shown in FIG. 5, a sleeve 200 is forcedly fitted to the upper end portion of the second tube member 20.

The connection portion 321 of the connection member 30 is inserted into the sleeve 200. In a state where the connection portion 321 is inserted into the sleeve 200, an annular washer 352 comes into close contact with the lower end portion of the sleeve 200, and a screw member 351 is threaded into a screw connection hole 326 formed in the lower end portion of the insert 323, thereby fixing the connection member 30 to the sleeve 200.

At this time, the outer diameter of the connection portion 321 and the inner diameter of the sleeve 200 are formed so that a predetermined gap is formed therebetween, and the lower end surface of the sleeve 200 is formed so as to be away from the washer 352 by a predetermined gap. That is, a small gap which is indicated by the bold line of FIG. 5 is formed between the connection portion 321 of the connection member 30 and the sleeve 200. Accordingly, the sleeve 200 is configured to be rotatable about the connection portion 321 of the connection member 30.

According to such a configuration, the sleeve 200 is rotatable relative to the connection portion 321 of the connection member 30, that is, the connection member 30, and the entire second tube member 20 which is forcedly fitted to the sleeve 200 is rotatable relative to the connection member 30.

Referring to FIGS. 3 and 4 again, the structure of the first tube member 10 will be described.

The body of the first tube member 10 is provided with a button hole 101 to which the button 301 formed in the connection member 30 is fastened. The lower end portion of the first tube member 10 is provided with a second guide member 102 which allows the first guide member 302 provided in the connection member 30 to be easily accommodated.

Plural protrusions 103 are formed in a radial shape along the length direction of the first tube member 10 inside the body of the first tube member 10 and inside the second guide member 102, and plural rotation preventing grooves 104 are formed along the length direction of the first tube member 10 between two protrusions 103.

The positions of the respective rotation preventing grooves 104 correspond to the rotation preventing protrusions 303 and 304 formed in the connection member 30. In a case where the connection member 30 is inserted into the first tube member 10, each of the rotation preventing protrusions 303 and 304 is fastened to each of the rotation preventing grooves 104. According to such a configuration, the connection member 30 is prevented from rotating inside the first tube member 10. That is, the connection member 30 just straightly slides inside the first tube member 10 without any rotation.

Figure 6:
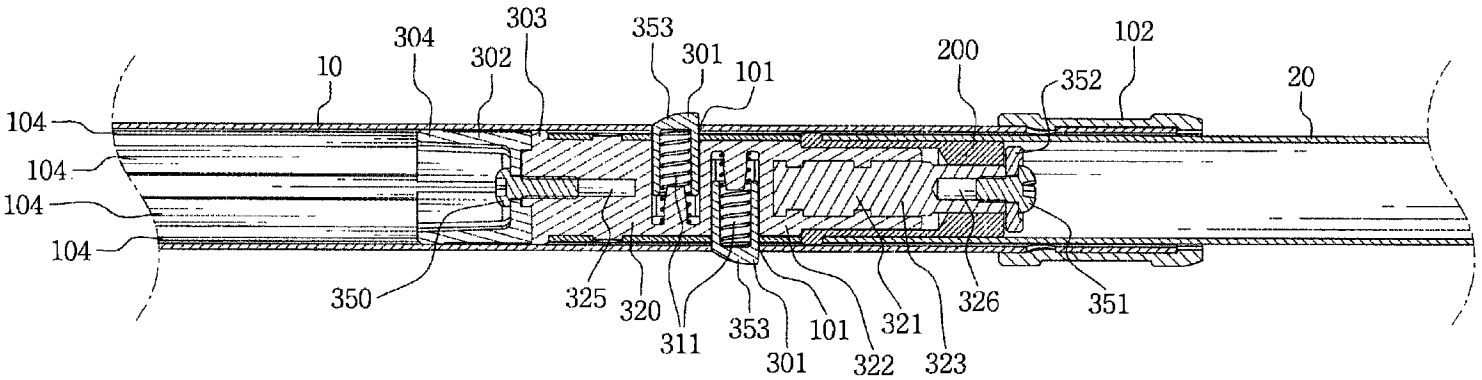
FIG. 6 is a cross-sectional view illustrating a state where the first tube member and the second tube member of FIG. 3 are connected to each other.

FIG. 6 is a cross-sectional view illustrating a state where the first tube member 10 and the second tube member 20 are fastened to each other through the connection member 30.

In order for the user to use the stick 1 (see FIG. 2) in a shortened state, first, the second tube member 20 accommodated inside the first tube member 10 is taken out in the downward direction of the first tube member 10. At this time, the connection member 30 just straightly slides inside the first tube member 10 without any rotation by the help of the rotation preventing protrusions 303 and 304 and the rotation preventing groove 104.

When the button 301 moves to the position of the button hole 101 while the second tube member 20 is taken out from the first tube member 10, the button 301 is fastened to the button hole 101 while exiting to the outside of the first tube member 10 through the button hole 101 (the button comes out by itself due to the elastic force of the spring 311 provided in the button 301). Since the button 301 is fastened to the button hole 101, the connection member 30 is locked with respect to the first tube member 10.

When the connection member 30 is locked with respect to the first tube member 10, the second tube member 20 and the first tube member 10 which are connected to the connection member 30 are fixed to each other, so that the entire length of the stick 1 is fixed to a length which is convenient for the user to use.

In contrast, in a case where the user desires to shorten the stick 1 again, the end portion of the button 301 which is exposed to the outside through the outer surface of the first tube member 10 is pressed so that the button 301 and the button hole 101 are separated from each other, and hence the connection member 30 is unlocked with respect to the first tube member 10.

When the second tube member 20 is pressed upward while the button 301 is pressed so that the connection member 30 is unlocked from the first tube member 10, the length of the stick 1 is shortened while the second tube member 20 and the connection member 30 slides inside the first tube member 10 (see FIG. 2).

According to the embodiment, the end portion of the button 301 is inclined so that a slope surface 353 faces the opposite side to the installation position of the second tube member 20, that is, the upper side of the stick 1, which easily separates the button 301 from the button hole 101 when the second tube member 20 is pressed into the first tube member 10 and prevents the second tube member 20 from completely coming out from the first tube member 10 after the button 301 passes by the button hole 101 when the second tube member 20 is taken out from the first tube member 10.

To sum up this, the connection member 30 is selectively locked to or unlocked from the first tube member 10 as the button 301 is fastened to or separated from the button hole 101, and hence the second tube member 20 is selectively locked to or unlocked from the first tube member 10.

In a state where the stick 1 according to the embodiment is shortened, a rotational force may be applied to the second tube member 20 due to the user or other external environmental factors. If the second tube member 20 is rigidly connected to the connection member 30, when a rotational force is applied to the second tube member 20, the connection member 30 rotates along with the second tube member 20, so that the button 301 formed in the connection member 30 may be deviated from the button hole 101.

As one of methods of preventing such a phenomenon, there is a known method of increasing the depth of the rotation preventing groove 104 formed inside the first tube member 10 and increasing the heights of the rotation preventing protrusions 303 and 304 formed in the connection member 30 so as to correspond to an increase in the depth. However, since a difference between the diameter of the first tube member 10 and the diameter of the connection member 30, that is, a difference between the diameter of the first tube member 10 and the diameter of the second tube member 20 inevitably increases as the sizes of the rotation preventing groove 104 and the rotation preventing protrusions 303 and 304 increase, the rigidity of the stick 1 remarkably decreases.

According to the embodiment, when a rotational force is applied to the second tube member 20, the rotational force which is applied to the second tube member 20 is canceled while the sleeve 200 which is connected to the second tube member 20 freely rotates relative to the connection portion 321 of the connection member 30. Accordingly, even in a case where a rotational force is applied to the second tube member 20, the relative position of the connection member 30 with respect to the first tube member 10 is maintained as it is, thereby preventing a deviation in the position of the button 301 due to the rotational force which is applied to the second tube member 20.

According to such a configuration, since the rotation preventing protrusion and the rotation preventing groove may be formed in a small size in which the connection member 30 does not simply rotate inside the first tube member 10, the inner diameter portion of the first tube member 10 and the outer diameter portions of the second tube member 20 and the connection member 30 may come into close contact with each other as much as possible. Accordingly, there is an advantage that the entire rigidity of the stick 1 may be improved.

On the other hand, a rotational force may be applied to the second tube member 20 even in a state where the stick 1 according to the embodiment is lengthened and the button 301 is fastened to the button hole 101. Even at this time, since the second tube member 20 is rotatably connected to the connection member 30, the rotational force of the second tube member 20 is not transmitted to the connection member 30.

Accordingly, the relative position of the connection member 30 with respect to the first tube member 10 is maintained as it is, so that any force is not applied to the button 301 which is a locking unit that maintains the locking state of the first tube member 10 and the second tube member 20. Therefore, the button 301 is prevented from being damaged due to the rotational force applied to the second tube member 20.

Furthermore, according to the embodiment, since the second tube member 20 is rotatable relative to the first tube member 10 in any state where the stick 1 is lengthened or shortened, it is possible to prevent that the rotation force which is applied to the second tube member 20 is transmitted to the first tube member 10 so that the first tube member 10 rotates. Accordingly, for example, in a case where the upper tube member 2 (see FIG. 1) and the first tube member 10 are fixed and connected by a screw locking type connection structure, since it is possible to prevent the screw locking unit of the upper tube member 2 and the first tube member 10 from being unexpected unlocked as the first tube member 10 rotates due to the external factor, the reliability of the stick 1 improves.

Figure 7:
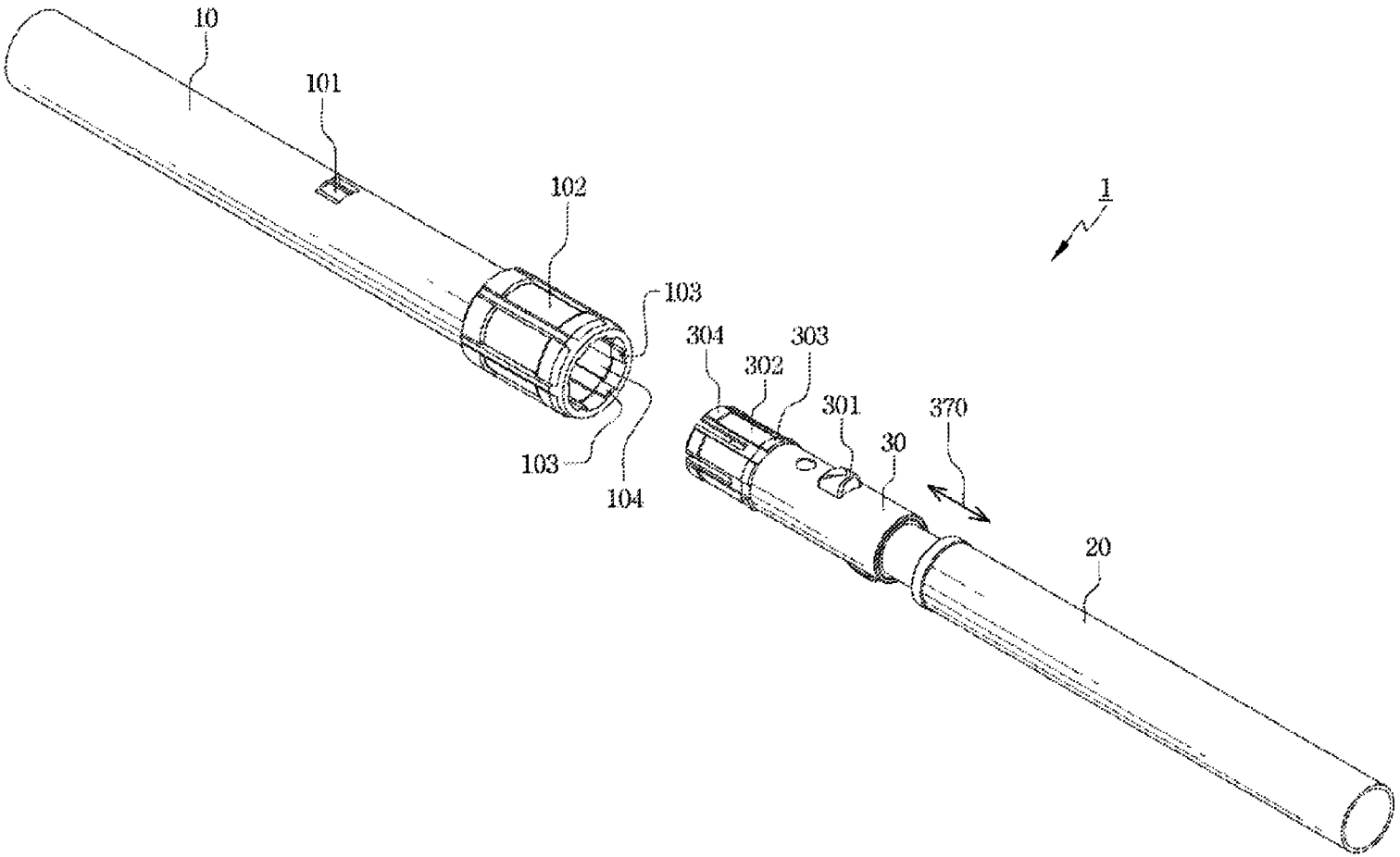
FIG. 7 illustrates a part of a first tube member, a second tube member, and a connection member of a stick according to another embodiment of the disclosure.
Figure 8:
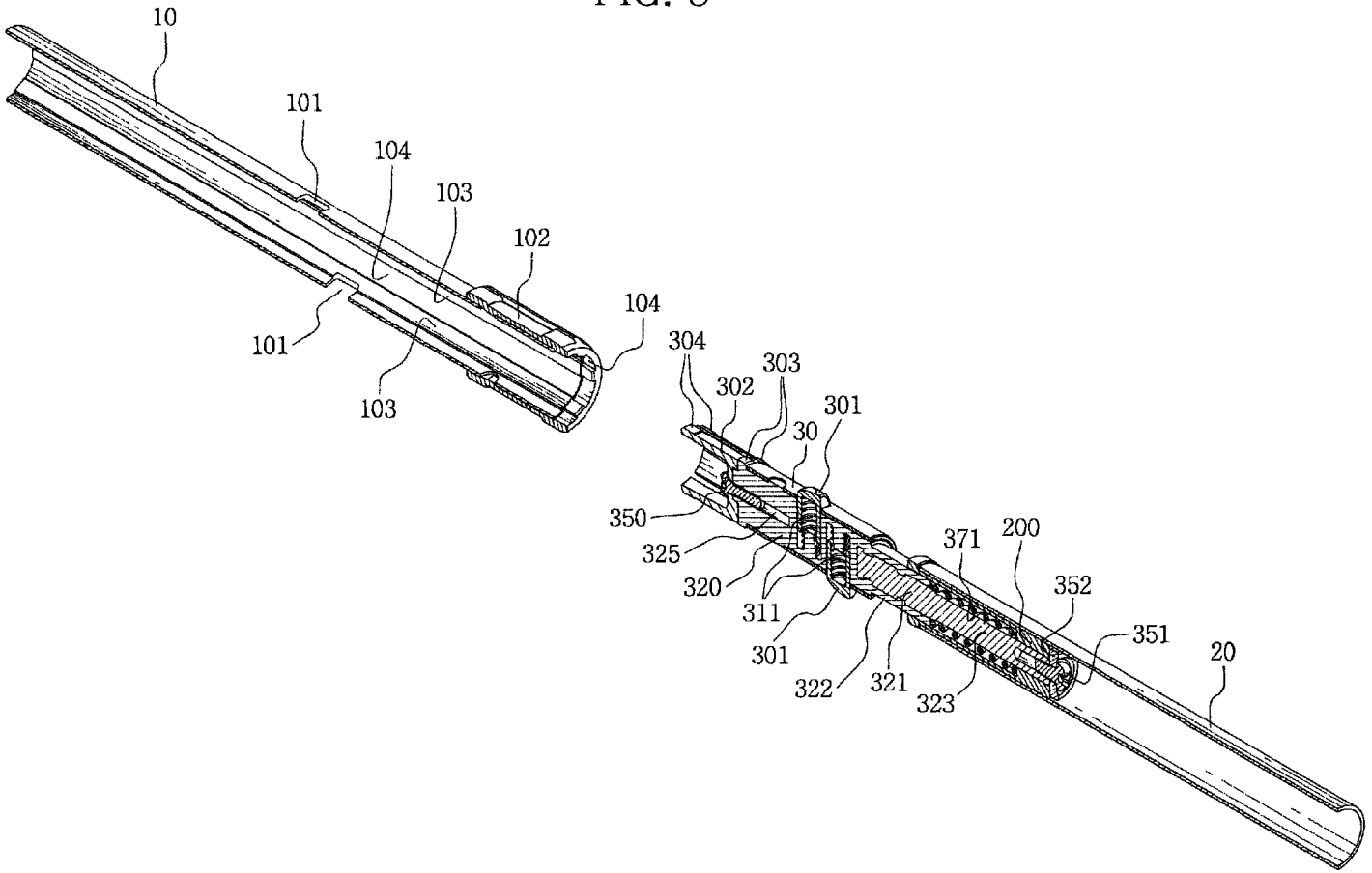
FIG. 8 is a cross-sectional perspective view in which the first tube member, the second tube member, and the connection member of FIG. 7 are cut away in the length direction.

FIGS. 7 and 8 illustrate the stick 1 according to another embodiment of the disclosure. In FIGS. 7 and 8, only the first tube member 10, the second tube member 20, and the connection member 30 of the stick 1 are shown.

The embodiment is different from the above-described embodiment in that the lower end portion of the body portion 320 of the connection member 30 does not come into close contact with the upper end portion of the second tube member 20, but is away therefrom by a predetermined distance 370 and a part of the connection portion 321 of the connection member 30 is exposed to the outside. Such a distance 370 is formed by forming the length of the insert 323 of the connection portion 321 according to the embodiment so as to be longer than the length of the insert according to the above-described embodiment. Furthermore, according to the embodiment, a spring 371 is provided between the insert 323 as a part of the connection portion 321 and the sleeve 200.

The shape and the operation of the entire configuration of the stick 1 according to the embodiment except for the above-described difference are the same as the shape and the operation of the configuration of the stick according to the above-described embodiment. The same reference numerals are given to the corresponding components in two embodiments.

Figure 9:
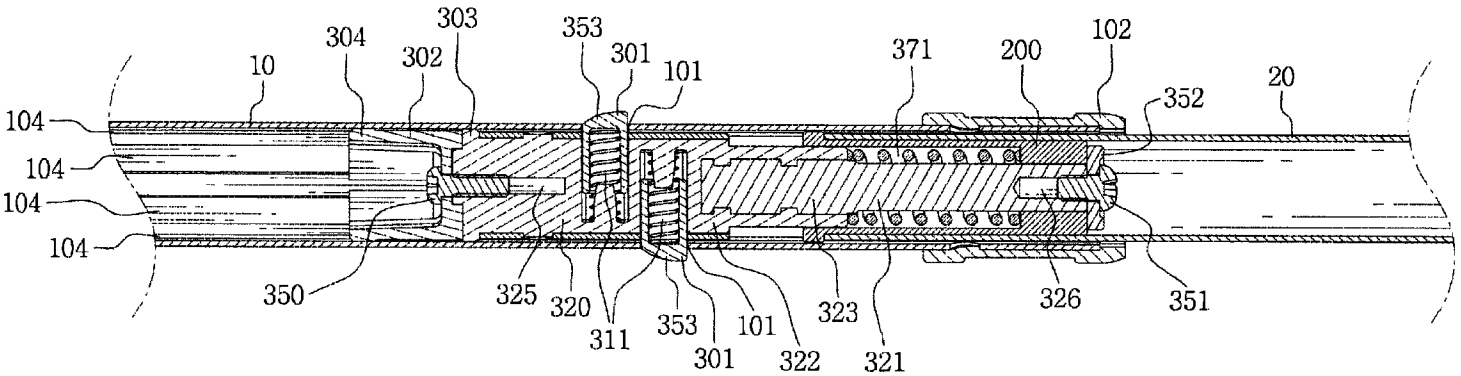
FIGS. 9 and 10 are cross-sectional views illustrating a state where the first tube member and the second tube member of FIG. 7 are connected to each other.
Figure 10:
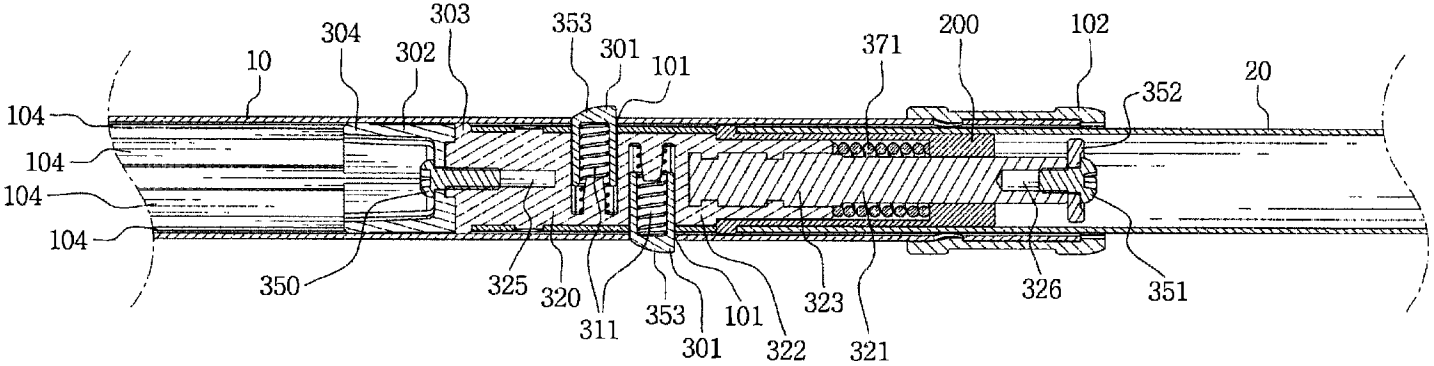

FIGS. 9 and 10 are diagrams illustrating a principle in which the stick 1 according to the embodiment absorbs an impact.

Referring to FIGS. 9 and 10, the sleeve 200 is not only rotatable about the connection portion 321 of the connection member 30, but also slidable with respect to the connection portion 321 of the connection member 30.

In the state shown in FIG. 9, when the user presses the stick 1 against the ground, an impact is applied from the ground to the second tube member 20 in the upward direction. Due to such an impact, as shown in FIG. 10, the sleeve 200 slides along the connection portion 321 in the upward direction, and the second tube member 20 which is connected to the sleeve 200 moves in the upward direction. At this time, the spring 371 which is disposed between the connection portion 321 and the sleeve 200 is compressed.

Since no impact is transmitted to the connection member 30 and the first tube member 10 because the impact applied to the second tube member 20 is removed as the sleeve 200 slides along the connection portion 321, no impact is applied to the user which grips the stick.

When the impact which is applied to the second tube member 20 disappears, the sleeve 200 and the second tube member 20 return to the original position shown in FIG. 9 due to the elastic force of the spring 371.

According to the present disclosure, as in the above-described embodiment, the second tube member 20 freely rotates relative to the connection member 30, so that the rotational force applied to the second tube member 20 is not transmitted to the connection member 30, but also the longitudinal force applied to the second tube member 20 is not applied to the connection member 30, which has an advantage that the impact applied to the stick 1 may be absorbed.

While the exemplary embodiments have been shown and described, it will be understood by those skilled in the art that various changes in form and details may be made thereto without departing from the spirit and scope of the present disclosure as defined by the appended claims.

What is claimed is:

1. A stick comprising:

a first tube member and a second tube member telescopically connected to each other such that the second tube member is dimensioned so as to move longitudinally within the first tube member;

a sleeve inserted into an end portion of the second tube member, the sleeve comprising an opening at a first end thereof, and a bottom wall portion at a second end thereof, opposite the first end, such that a cavity is formed between the first and second ends, and wherein the sleeve is rotationally and longitudinally locked with respect to the second tube member;

a connection member, said connection member comprising a connection portion and a body portion opposite the connection portion, the connection portion disposed at least partially within the cavity of the sleeve, and the body portion comprising at least one radially directed, resiliently biased button configured to engage with at least one button hole formed in the first tube member, wherein the connection member is both freely rotatable and longitudinally slidable with respect to the sleeve; and a spring disposed within the cavity of the sleeve, wherein a first end of the spring abuts the bottom wall portion and an opposing, second end of the spring abuts at least a portion of the connection portion of the connection member;

wherein when the first tube member is selectively locked to the connection member by the at least one button extending through the at least one button hole:

the second tube member is freely rotatable relative to the first tube member so that rotational forces applied to the second tube member are not transmitted to the connection member or the first tube member, and longitudinal forces applied to the second tube member towards the first tube member are absorbed at least partially by the spring.

2. The stick according to claim 1, wherein the first tube member and the second tube member have a cylindrical shape, and the connection member and the second tube member are slidable inside the first tube member.

3. The stick according to claim 2, wherein the inside of the first tube member is provided with a rotation preventing groove formed along the longitudinal direction of the first tube member, the body portion of the connection member is provided with a rotation preventing protrusion configured to be fastened to the rotation preventing groove, such that the connection member is prevented from rotating inside the first tube member.

4. The stick according to claim 3, wherein the button hole penetrates the outer surface of the first tube member, and when the button is fastened to the button hole, an end portion of the button is exposed to the outside of the first tube member.

5. The stick according to claim 4, wherein the end portion of the button includes a sloped surface, and the end portion of the button is inclined so that the sloped surface faces an opposite side of the connection portion of the connection member.

* * * * *